US005765834A

United States Patent [19]

Engli

[11] Patent Number: 5,765,834

[45] Date of Patent: Jun. 16, 1998

[54] SEALING DEVICE

[75] Inventor: Knut Engli, Oslo, Norway

[73] Assignee: Alcatel Kabel Norse AS, Oslo, Norway

[21] Appl. No.: 595,384

[22] Filed: Feb. 1, 1996

[30] Foreign Application Priority Data

Feb. 3, 1995 [NO] Norway ..... 950395

[51] Int. Cl.[6] ..... F16J 15/56

[52] U.S. Cl. ..... 277/101; 277/104; 277/105; 277/193

[58] Field of Search ..... 277/101, 104, 277/105, 192, 193; 285/317, 320, 335, 346, 348; 138/89, 108, 112; 174/77 R

[56] References Cited

U.S. PATENT DOCUMENTS

| | | | |
|---|---|---|---|
| 870,428 | 11/1907 | Graham | 277/101 |
| 1,682,543 | 8/1928 | White | 277/193 |
| 2,197,450 | 4/1940 | Curtis | 277/101 |
| 2,237,680 | 4/1941 | Mark | 277/104 |
| 2,258,135 | 10/1941 | Curtis | 277/101 |
| 2,258,190 | 10/1941 | Neilon | 277/105 |
| 3,257,118 | 6/1966 | Broadhead et al. | 277/104 |
| 4,220,360 | 9/1980 | Jacek et al. | 285/317 |
| 4,377,291 | 3/1983 | Albertini | 277/105 |
| 4,858,963 | 8/1989 | Kimbrough | 285/346 |
| 4,993,724 | 2/1991 | Hauff | 277/193 |

FOREIGN PATENT DOCUMENTS

| | | |
|---|---|---|
| 1147375 | 4/1969 | United Kingdom . |
| 2188999 | 10/1987 | United Kingdom . |
| 2281365 | 3/1995 | United Kingdom . |

*Primary Examiner*—William A. Cuchlinski, Jr.
*Assistant Examiner*—John L. Beres
*Attorney, Agent, or Firm*—Ware, Fressola, Van Der Sluys & Adolphson LLP

[57] ABSTRACT

This invention relates to a sealing device for sealing off an elongated body (1), such as a cable, pipe or umbilical, at its entrance into an aperture (7) of an apparatus, such as an offshore J-tube (8). The sealing device (2) consists of two substantially identical parts or halves (3,4) which are hinged together along an axis (5') substantially parallel to the axis of the elongated body (1), each half comprising a centralizer part (20), a sealing part (21) and tensioning parts (13,16,22) capable of pressing the sealing parts (21) into sealing contact against the elongated body (1), against the inner surface of the J-tube (8) and against the centralizing means (20).

11 Claims, 1 Drawing Sheet

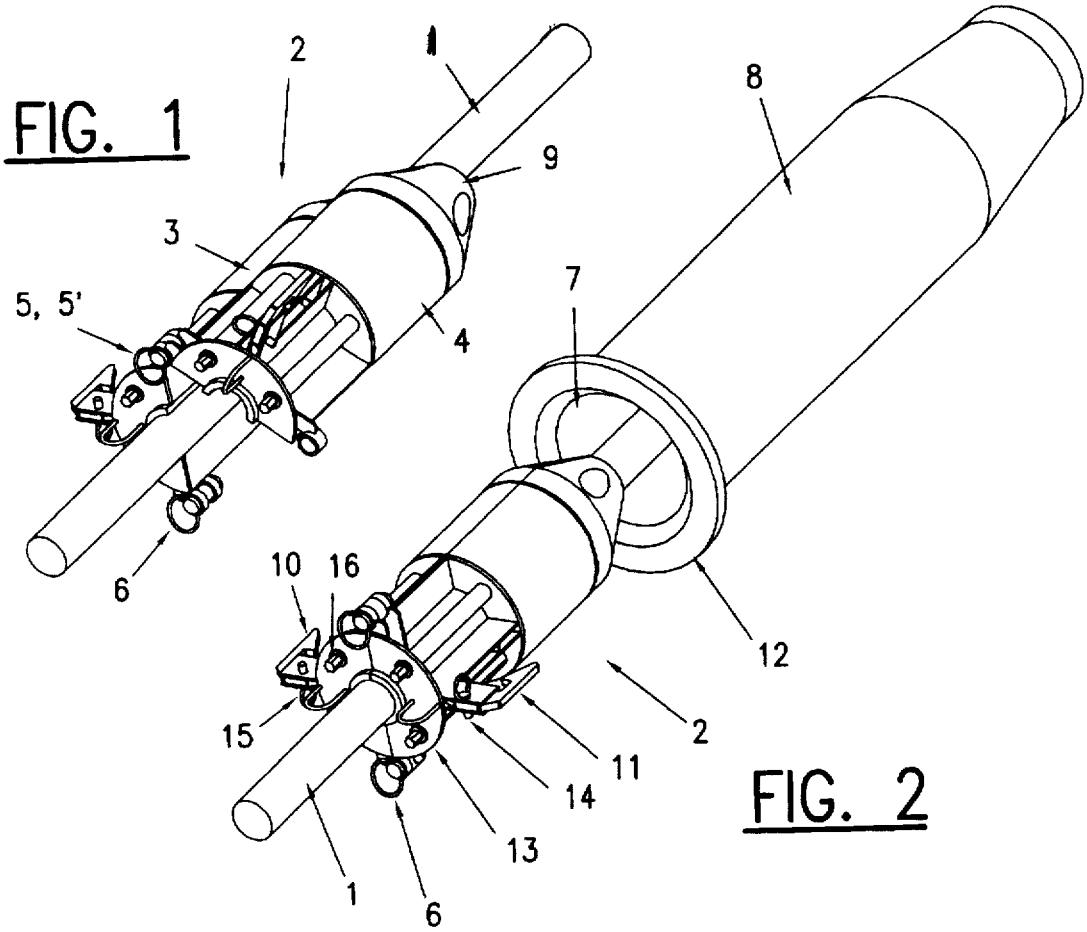
FIG. 1
FIG. 2
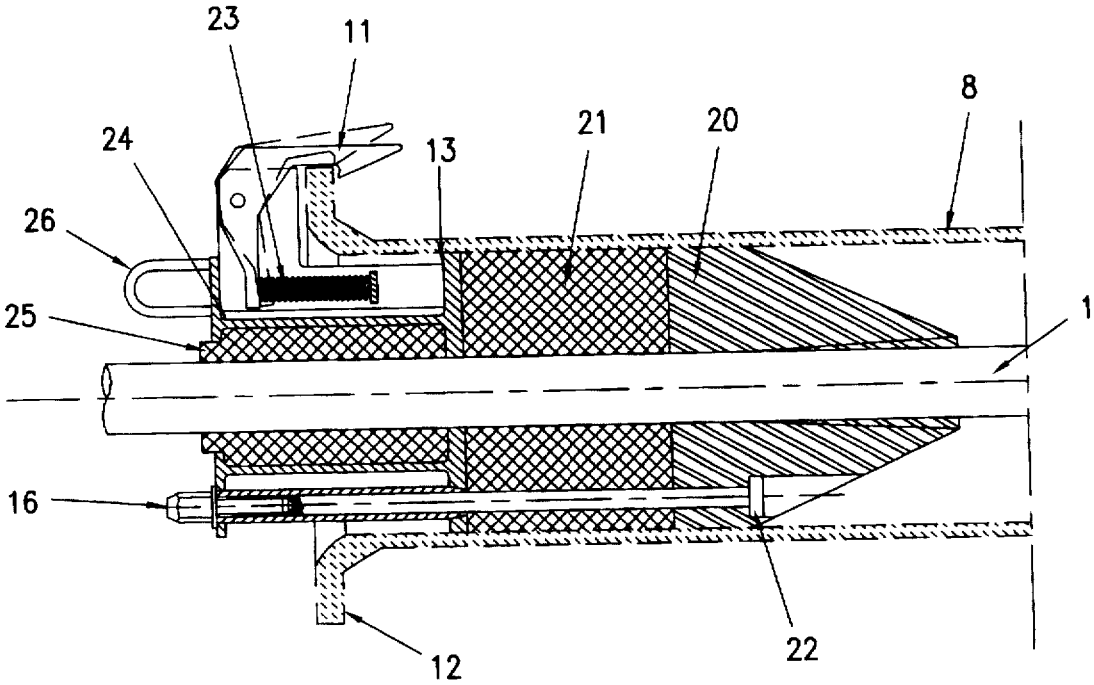
FIG. 3

SEALING DEVICE

TECHNICAL FIELD

The present invention relates to a sealing device for sealing off an elongated body, such as a cable, a pipe or an umbilical, at its entrance into an apparatus, in particular at the lower horizontal end of an offshore J-tube, leading from the sea bed up to a platform structure. The sea bed may be several hundred meters below the sea level.

BACKGROUND OF THE INVENTION

In some cases it is desirable, after an elongated body has been installed within a J-tube, that the sea water surrounding the body within the J-tube is deoxidized to prevent or reduce corrosion. In order to neutralize the sea water in the tube, inhibiting agents are added to the water, and the inside pressure is normally some 5–6 bar more than the pressure of the surrounding water. A problem arises, however, due to difficulties in obtaining a full seal between the surface of the elongated body and the tube entrance. If the seal is poor, - the external sea water will be gradually exchanged with the inhibited sea water within the tube. A suitable sealing device should also prevent pollution that might be caused by leaking inhibiting agents into the sea.

From our British Patent No 2188999 (B Friis 3) there is known a sealing device comprising at least two elements which are arranged to be pressed against each other, against a circumference of the elongated body and against the aperture of said apparatus. At least one of the elements is hinged to the apparatus.

In our copending British patent No 2,281,365 (J. E. Karlsen 2x) a sealing device comprises centralizing means arranged around the elongated body inside a pull-in-flange at the lower entrance of the J-tube, sealing means arranged around the elongated body next to the centralizing means, and formed as a one-piece split annulus, the split being in a plane substantially parallel to the axis of the annulus and to the axis of the elongated body, and pressure means for pressing the sealing means to sealing contact against the elongated body, against the flange surface and against the centralizing means.

SUMMARY OF THE INVENTION

The main object of the present invention is to make an alternative efficient full seal at the entrance of a J-tube.

The main feature of the invention is a sealing device for sealing off an elongated body, such as a cable, pipe or umbilical, at its entrance into an aperture of an apparatus, such as an offshore J-tube, characterized in that it consists of two substantially identical halves which are hinged together along an axis substantially parallel to the axis of the elongated body, each half comprising a centralizer part formed at a first end thereof having a recess for receipt of a portion of the elongated body, a sealing part contacting the centralizer part at one surface thereof and having a recess for receipt of a portion of the elongated body, and tensioning parts contacting the centralizer part and sealing part, for pressing the sealing part into sealing contact against the elongated body, against the inner surface of the J-tube and against the centralizing means.

A further feature is such a sealing device wherein the tensioning parts consist of tensioning rods capable of squeezing each sealing part between its centralizer part and its holding device, thereby pressing the two sealing parts together, against the elongated element and against the inner surface of the J-tube.

A still further feature is such a sealing device which has ring pins for interlocking the two halves.

Another feature is such a sealing device that includes a friction element to exert friction against the surface of the elongated body when the two halves are interlocked.

With this invention there is obtained an efficient sealing device which may be installed by an ROV. The sealing device may also be removed and reinstalled by an ROV, after installing the elongated body within the J-tube.

BRIEF DESCRIPTION OF THE DRAWINGS

Above mentioned and other features and objects of the present invention will clearly appear from the following detailed description of embodiments of the invention taken in conjunction with the drawings, where FIGS. 1 and 2 schematically show two phases of installation, and FIG. 3 shows a cross-section of an installed sealing device.

BEST MODE FOR CARRYING OUT THE INVENTION

In FIG. 1 is shown an elongated body 1 and a hinged sealing device 2 about to be installed on the body. The sealing device consists of two identical parts 3 and 4. The two parts are hinged together with a ring pin 5 defining an axis 5' substantially parallel to the axis of the elongated body 1, and the parts are locked together with a ring pin 6, or vice versa, as the two parts have identical design. The locked condition is shown in FIG. 2 where the right part of the elongated body 1 is shown inserted into an aperture 7 of a J-tube 8. The right hand side or inner end 9 of the sealing device is coned to facilitate its entering into the J-tube. The sealing device is provided with spring-loaded catching means 10 and 11 for locking the device to an outer flange 12 of the J-tube. The catching means 10 and 11 are secured to a holding devices 13 by means of ring pins 14 and 15. A spring 23 for the catching means 11 is shown in FIG. 3.

FIG. 3 shows a longitudinal cut through the locked sealing device 2 of FIG. 2 taken through the catch 11, the axis of the longitudinal body and a bolt nut 16, when inserted into the J-tube 8. The sealing device consists of centralizing means 20 and sealing means 21 as well as pressure means consisting of tensioning rods 22 with nuts 16. By tightening the nuts 16, the seal 21 is compressed and squeezed between the centralizer 20 and the holding device 13.

The holding device 13 is provided with a cylindrical compartment 24 for accommodating a friction element 25 (made up of two halves). When the two halves of the sealing device are locked together by means of the pins 5 and 6, the sealing device may slide against a defined friction force on the surface of the elongated body, or vice versa.

The installation of the elongated body and of the sealing device can be performed as follows:

Before the elongated body 1 is lowered to the sea bed for insertion and pulling into the J-tube, the sealing device 2 is installed on the elongated body. Each of the two halves 3 and 4 of the sealing device is assembled from a centralizer part, a seal part and a holding device part with a friction element, by inserting the tensioning rod 22 through said parts without tightening the nut 16. The two halves 3 and 4 are then hinged together with the ring pin 5 and locked with the ring pin 6. The dimensions are chosen such that the centralizer 20 and seal 21 may slide freely on the surface of the elongated body 1 and freely within the J-tube 8, whereas the friction element 25 prevents uncontrolled axial movements of the sealing device on the surface of the elongated body.

The elongated body 1 with the sealing device 2 is now carefully lowered from the cable ship to the subsea entrance of the J-tube. The end of the elongated body is pulled into and up through the J-tube to a topside termination and installation. The sealing device 2 is installed within the J-tube at any time during installation of the elongated body within the J-tube, and the catching means 10 and 11 catch the J-tube flange 12. As soon as the desired position of the elongated body within the J-tube and sealing device is obtained, the nuts 16 are tightened to obtain the effect that the seal parts 21 are pressed together and compressed into sealing contact against the surface of the elongated body 1, against the inner surface of the J-tube 8 and against the centralizing means 20.

The only action required by an ROV is to tighten the nuts 16. The inside surface of the centralizer 20 may be slightly coned - in front, as indicated—to facilitate its entrance into the J-tube.

Should it be necessary to remove the sealing device, an ROV should loosen the nuts 16, remove the ring pins 14 and 15 to release the catching means 10 and 11, pull out the sealing device 2 by means of pulling eyes 26 and dismount the ring pin 6 (and 5).

A hinged replacement device can easily be installed with an ROV by interlocking the two halves of the sealing device, pushing the device into the J-tube until the catching means 10 and 11 catch the flange 12, and tightening the nuts 16. The two halves may be provided with snap-lock means (not shown) for making the interlock. The friction element 25 may be left out of the replacement device.

The centralizer 20 is preferably made from a high-viscosity non-yielding material like polyamide (Nylon, PA6) or polyoxymetylene (POM). The centralizer material is therefore well suitable for withstanding the pressure from the rod head 22.

The seal 21 is made of a low viscosity silicone rubber, such as that having the designation RTV-2 (tradename Powerseal 600 of Wacker-Chemie). The hardness is some 25 Shore A whereas the compression set is 20% at 22 h and 150° C. Its surface roughness is very low and it seals well against other body surfaces. The friction element 25 is also made from silicone rubber.

The above detailed description of embodiments of this invention must be taken as examples only and should not be considered as limitations on the scope of protection.

I claim:

1. A sealing device (2) for sealing off a subsea elongated body (1), including a cable, pipe or umbilical, at an entrance into a subsea lower aperture (7) of an offshore J-tube (8), characterized in that the sealing device (2) consists of two substantially identical interlockable parts or halves (3, 4) which are hinged together along an axis (5') substantially parallel to the axis of the subsea elongated body (1), each substantially identical interlockable half (3, 4) comprising a centralizer part (20), a sealing part (21) and tensioning parts (13, 16, 22), said tensioning parts (13, 16, 22) capable of pressing the sealing part (21) to sealing contact against the subsea elongated body (1), against the inner surface of the J-tube (8) and against the centralizer part (20), and each substantially identical interlockable half (3, 4) includes friction means (25) for exerting a certain friction against the surface of the subsea elongated body (1), when the two substantially identical interlockable halves (3, 4) are interlocked, independent of the sealing pressure exerted by compressing the sealing part (21).

2. A sealing device (2) according to claim 1, characterized in that the sealing device (2) includes means (5, 6) for interlocking and releasing the two substantially identical interlockable halves (3, 4) by means of a remotely operable vehicle (ROV).

3. A sealing device (2) according to claim 1, characterized in that each substantially identical interlockable half (3, 4) includes means (10, 11) for interlocking and releasing with a flange (12) of the J-tube by means of a remotely operated vehicle (ROV).

4. A sealing device (2) according to claim 1, characterized in that the sealing device (2) includes means (10, 11) for interlocking with a flange (12) of the J-tube that are spring loaded catching means.

5. A sealing device (2) according to claim 1, characterized in that the sealing parts (21) are made of a low viscosity silicone rubber.

6. A sealing device (2) according to claim 1, characterized in that the centralizing parts (20) are made of a high viscosity material, including polyamide (Nylon, PA6) or polyoxymethylene (POM).

7. A sealing device according to claim 4, characterized in that the friction parts (25) are made of a low viscosity silicone rubber.

8. A sealing device according to claim 1, wherein when the two substantially identical interlockable halves (3, 4) are interlocked the friction means (25) forms a cylindrical body having a cylindrical bore for receiving the surface of the subsea elongated body (1) and for exerting the certain friction thereon.

9. A sealing device (2) for sealing off an elongated body (1), including a cable, pipe or umbilical, at its entrance into an aperture (7) of an apparatus, including an offshore J-tube (8), characterized in that the sealing device (2) consists of two substantially identical halves (3, 4) which are hinged together along an axis (5') substantially parallel to the axis of the elongated body (1), each half comprising a centralizer part (20) having a first tapered end for fitting into the aperture (7) of the offshore J-tube (8), and having a recess for receipt of a portion of the elongated body (1), a sealing part (21) contacting the centralizer part (20) at one surface thereof and having a recess for receipt of a portion of the elongated body (1), tensioning means (13, 16, 22) contacting the centralizer part (20) and sealing part (21), for pressing the sealing part (21) into sealing contact against the elongated body (1), against the inner surface of the J-tube (8) and against the centralizer part (20), friction means (25) for exerting a certain friction against the surface of the subsea elongated body (1), when the two substantially identical interlockable halves (3, 4) are interlocked, independent of the sealing pressure exerted by compressing the sealing part (21), and a catching means (10, 11) for locking the sealing device to a portion (12) of the J-tube (8).

10. A sealing device according to claim 9, wherein the portion (12) of the J-tube (8) is a flange (12) at one end thereof, and wherein the catching means (10, 11) is spring loaded for interlocking with the flange (12) of the J-tube (8).

11. A sealing device for sealing off an elongated body (1), including a cable, pipe or umbilical, at an entrance into an aperture (7) of an offshore J-tube (8) having an outer flange (12), comprising:

a first sealing half (3); and a second sealing half (4) being hingedly connected to the first sealing half (3), the second sealing half (4) being substantially identical to the first sealing half (3);

each sealing half (3, 4) including a tensioning means (13, 16, 22) having a holding device (13), tensioning rods (22) and tension nuts (16) connected thereto, a centralizer means (20) having an end surface, having a tapered cylindrical end surface for fitting into the aperture (7) of the offshore J-tube (8), having a central bore for receiving the elongated body (1), having tensioning rod bores for receiving the tensioning rods (22) passing through the end surface and the tapered cylindrical end surface, a sealing means (21) having a central sealing bore for receiving the elongated body (1), having sealing tensioning rod bores for receiving the tensioning rods (22), and being compressible for making sealing contact with the elongated body (1), an inner surface of the J-tube (8), a respective surface of the tensioning rods (22) and the end surface of the centralizer part (20) when the sealing device is received about the elongated body (1) and inserted into the aperture (7) of the offshore J-tube (8), and the tension bolts (16) are tightened against the holding device (13), and a spring-loaded catching means (10, 11) for locking the sealing device to the outer flange portion (12) of the J-tube (8).

* * * * *

UNITED STATES PATENT AND TRADEMARK OFFICE

CERTIFICATE OF CORRECTION

PATENT NO. : 5,765,834
DATED : June 16, 1998
INVENTOR(S) : ENGLI

It is certified that error appears in the above-identified patent and that said Letters Patent is hereby corrected as shown below:

On the title page, item
[57] ABSTRACT "the sealing parts (21)" should read

--the sealing part (21)--

Signed and Sealed this
Twenty-fourth Day of November, 1998

*Attest:*

*Attesting Officer*

BRUCE LEHMAN

*Commissioner of Patents and Trademarks*